US009827794B2

(12) United States Patent
Miyamoto

(10) Patent No.: US 9,827,794 B2
(45) Date of Patent: Nov. 28, 2017

(54) DISCHARGE POSITION ADJUSTING METHOD AND DROPLET EJECTING APPARATUS

(71) Applicant: Seiko Epson Corporation, Tokyo (JP)

(72) Inventor: Toru Miyamoto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/070,292

(22) Filed: Mar. 15, 2016

(65) Prior Publication Data

US 2016/0279927 A1 Sep. 29, 2016

(30) Foreign Application Priority Data

Mar. 25, 2015 (JP) ..... 2015-062175

(51) Int. Cl.
*B41J 19/14* (2006.01)
*B41J 2/21* (2006.01)

(52) U.S. Cl.
CPC ..... *B41J 19/145* (2013.01); *B41J 2/2135* (2013.01)

(58) Field of Classification Search
CPC ..... B41J 2/04505; B41J 2/04586
See application file for complete search history.

(56) References Cited

U.S. PATENT DOCUMENTS

2011/0007112 A1 1/2011 Takei et al.

FOREIGN PATENT DOCUMENTS

| | | | |
|---|---|---|---|
| JP | 2003-266700 | A | 9/2003 |
| JP | 2005-305694 | A | 11/2005 |
| JP | 2011-031611 | A | 2/2011 |
| JP | 2013-230693 | A | 11/2013 |

*Primary Examiner* — Alessandro Amari
*Assistant Examiner* — Roger W Pisha, II
(74) *Attorney, Agent, or Firm* — Harness, Dickey & Pierce, P.L.C.

(57) ABSTRACT

A discharge position adjusting method includes: moving a first nozzle row and a second nozzle row in scanning directions, each of the first and second nozzle rows having a plurality of nozzles that eject liquid droplets, the first and second nozzle rows being disposed at different locations in a predetermined direction, the scanning directions intersecting the predetermined direction; forming a first image by ejecting liquid droplets from the first nozzle row, and forming a second image by ejecting liquid droplets from the second nozzle row; and adjusting positions at which liquid droplets are to be placed by using the first and second images. The first and second images are created during the moving of the first and second nozzle rows.

7 Claims, 14 Drawing Sheets

DISCHARGE POSITION ADJUSTING METHOD AND DROPLET EJECTING APPARATUS

BACKGROUND

1. Technical Field

The present invention relates to a discharge position adjusting method in which a droplet ejecting apparatus is used and to a droplet ejecting apparatus that employs the discharge position adjusting method to adjust the positions of dots to be created.

2. Related Art

Ink jet printers are a known example of droplet ejecting apparatuses. Such ink jet printers eject liquid droplets (ink droplets) onto various print media, including a paper sheet or a film, thereby printing or recording images thereon. Some ink jet printers perform a dot creating operation and a transport operation; in the dot creating operation, the head ejects ink droplets onto a print medium through a plurality of nozzles formed in the head while moving over or scanning the print medium in scanning directions, and in the transport operation, the print medium is moved or transported in a transport direction intersecting the scanning directions. Alternately repeating these dot creating and transport operations creates dots (dot rows) arranged in the scanning directions, creating an image on the print medium.

In order for ink jet printers, as described above, to create images with higher resolutions, finer nozzles in the heads tend to be arrayed at higher densities. With this tendency, print time typically increases, but some ink jet printers reduces an increase in print time by performing bidirectional printing; in bidirectional printing, a head creates dots when moving not only in a first scanning direction, which is one of the scanning directions, but also in a second scanning direction, which is opposite to the first direction. This bidirectional printing involves a highly precise adjustment of the relative position of respective dots to be created by the movements in the first and second scanning directions. This adjustment is referred to as "bid adjustment". For example, JP-A-2003-266700 discloses a method of adjusting the positions of dots to be created, in which a variable dot printer that selectively ejects ink droplets of different sizes can perform the bid adjustment effectively.

In the disclosed method, bid adjustment needs to be performed head by head. So, if an ink jet printer that supports high-speed printing with multiple heads employs this method, the adjusting time may disadvantageously increase.

SUMMARY

An advantage of some aspects of the invention is that a discharge position adjusting method and a droplet ejecting apparatus make it possible to efficiently adjust relative positions of dots to be created. The discharge position adjusting method and the droplet ejecting apparatus can be embodied by aspects, embodiments, and modifications that will be described below.

First Aspect

A discharge position adjusting method includes: moving a first nozzle row and a second nozzle row in scanning directions, each of the first and second nozzle rows having a plurality of nozzles that eject liquid droplets, the first and second nozzle rows being disposed at different locations in a predetermined direction, the scanning directions intersecting the predetermined direction; forming a first image by ejecting liquid droplets from the first nozzle row, and forming a second image by ejecting liquid droplets from the second nozzle row; and adjusting positions at which liquid droplets are to be placed by using the first and second images. The first and second images are created during the moving of the first and second nozzle rows.

According to the first aspect, the first image created by the ejection of liquid droplets from the first nozzle row and the second image created by the ejection of liquid droplets from the second nozzle row are used as images with which the positions of dots to be created are adjusted. In addition, the first and second images are created during the moving of the first and second nozzle rows in the scanning directions. In short, both the first and second images, which are used to adjust the positions of dots to be created by the first and second nozzle rows, can be created during the moving of the first and second nozzle rows in the scanning directions. The positions of dots to be created can thereby be adjusted in a short time.

Second Aspect

In the discharge position adjusting method according to the first aspect, the first and second nozzle rows are moved multiple times, and the first and second images are created while the first and second nozzle rows are reciprocating in the scanning directions.

The first and second images created by the first and second nozzle rows are referenced when the positions of dots to be created are adjusted. In addition, the first and second images are created during the moving of the first and second nozzle rows in the scanning directions. According to the second aspect, the first and second images are created by multiple movements of the first and second nozzle rows. In other words, images used for the adjustment, or adjustment patterns, can be created by an arbitrary number of movements of the first and second nozzle rows. Consequently, every time the first and second nozzle rows are moved, adjustment patterns can be created under different setting conditions. This enables the adjustment to be made precisely by using different setting conditions, thereby achieving high-quality printing, for example.

Third Aspect

In the discharge position adjusting method according to the first aspect, each of the first and second images includes a plurality of first dot rows and a plurality of second dot rows. The first dot rows are created in the predetermined direction by movement of the first nozzle row in a first scanning direction when the first image is created. The second dot rows are created in the predetermined direction and within intervals between the first dot rows by movement of the second nozzle row in a second scanning direction when the second image is created. The first scanning direction is one of the scanning directions, and the second scanning direction is opposite to the first scanning direction.

According to the third aspect, the first dot rows are first created in the first direction by the movement of the first nozzle row in the first scanning direction, and then the second dot rows are created in the predetermined direction and within intervals between the first dot rows by the movement of the second nozzle row in the second scanning direction. The relative position of the first and second dot rows created in this manner can thereby be visually perceived.

Fourth Aspect

A droplet ejecting apparatus includes a first nozzle row and a second nozzle row disposed at different locations in a predetermined direction. Each of the first and second nozzle rows have a plurality of nozzles that eject liquid droplets. A scanning movement section moves the first and second nozzle rows in scanning directions intersecting the predetermined direction. An adjustment section adjusts locations at which liquid droplets are to be placed by using a first image and a second image. The first image is created from liquid droplets ejected by the first nozzle row, and the second image is created from liquid droplets ejected by the second nozzle row. The first and second images are created from the liquid droplets ejected by the first and second nozzle rows while the scanning movement section is moving the first and second nozzle rows in the scanning directions.

According to the fourth aspect, the first image created by the ejection of liquid droplets from the first nozzle row and the second image created by the ejection of liquid droplets from the second nozzle row are used as images with which the positions of dots to be created are adjusted. In addition, it is not necessary to create the first and second images at different timings of nozzle rows (heads). The positions of dots to be created can thereby be adjusted in a short time.

Fifth Aspect

In the droplet ejecting apparatus according to the fourth aspect, the first and second nozzle rows are formed in different heads.

According to the fifth Aspect, the first and second nozzle rows can be formed in different heads. The first and second nozzle rows in different heads can eject liquid droplets while moving in the scanning directions, thereby creating, in the scanning directions, both the first and second images used to adjust the position at which liquid droplets are to be placed. The positions of dots to be created can thereby be adjusted in a short time.

Sixth Aspect

In the droplet ejecting apparatus according to the fourth aspect, the first and the second nozzle row at least overlap each other in the predetermined direction.

According to the sixth aspect, the first and the second nozzle row at least overlap each other in the predetermined direction. Therefore, dots can be created such that first dots created by ejection of ink droplets from the first nozzle row overlap second dots created by ejection of ink droplets from the second nozzle row. Consequently, the relative position of the first and second dots can be visually perceived without difficulty.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
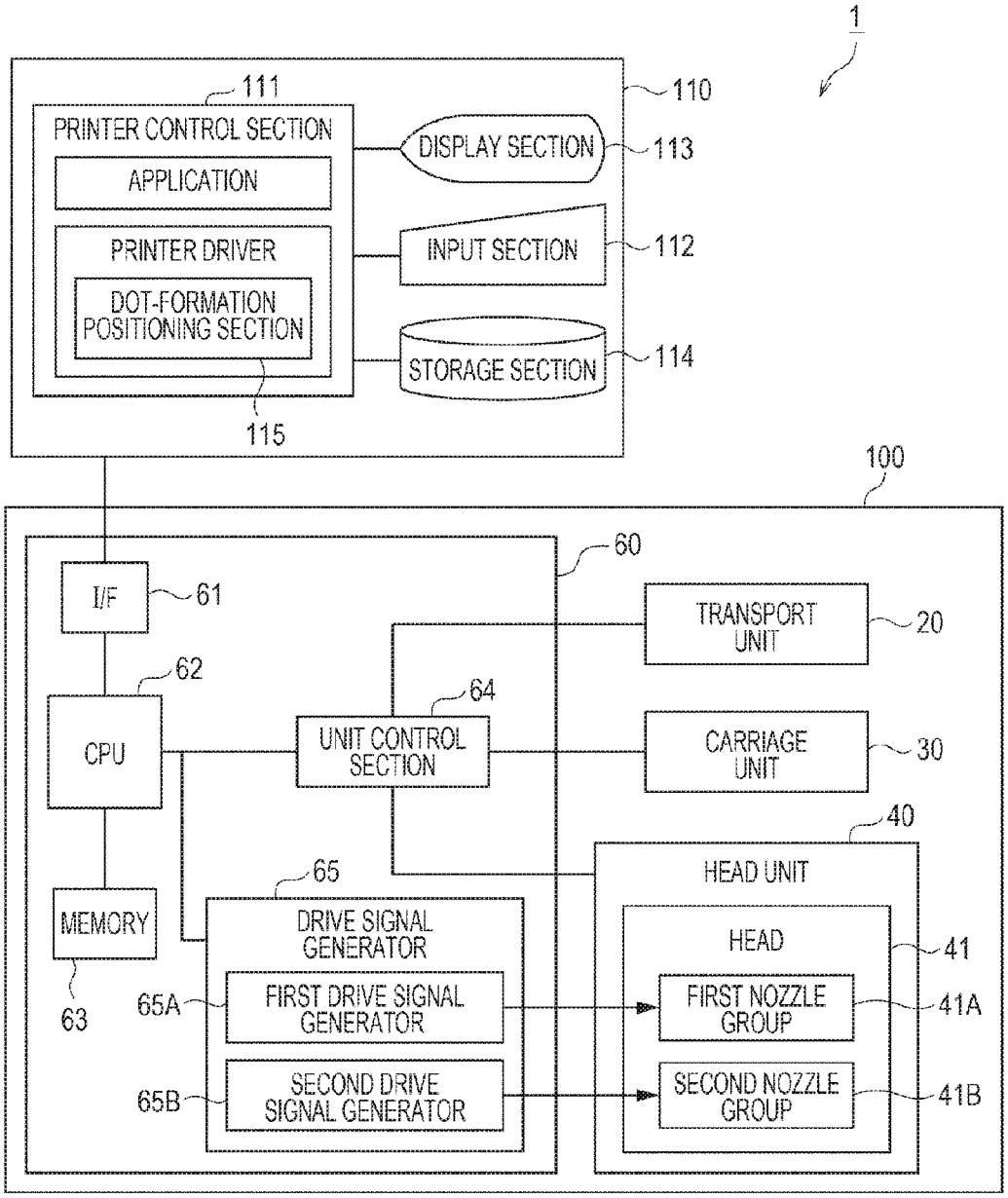
FIG. 1 is a block diagram illustrating an overall configuration of a droplet ejecting apparatus in a first embodiment of the invention.

Some embodiments of the invention will be described below with reference to the accompanying drawings. It should be noted that the following embodiments are exemplary and not intended to limit the invention. The scaling of some components illustrated in the drawings may differ from the scaling of actual components, for the purpose of easing the following description.

First Embodiment

FIG. 1 is a block diagram illustrating an overall configuration of a droplet ejecting apparatus in a first embodiment of the invention. A droplet ejecting apparatus 1 includes an ink jet printer 100, which prints an image on a print medium, and a personal computer 110. Hereinafter, the ink jet printer 100 is referred to as a printer 100, and the personal computer 110 is referred to as a PC 110. The PC 110 controls a print job that causes the printer 100 to print an image and includes a printer control section 111, an input section 112, a display section 113, and a memory section 114.

The printer control section 111 performs the centralized control of the entire droplet ejecting apparatus and includes a CPU (central processing unit) and memory cells, including RAM and ROM (all not illustrated). The input section 112 is an information input unit that serves as a human interface. More specifically, the input section 112 may be a keyboard or a port to which an information input device is to be connected, for example. The display section 113 is an information display unit (display) that serves as a human interface. More specifically, the display section 113 may display information received through the input section 112, information based on images to be printed by the printer 100, or associated print jobs under the control of the printer control section 111. The memory section 114 stores, for example, programs that can run on the PC 110 (printer control section 111), images to be printed, and information based on print jobs. The memory section 114 may be a hard disk drive (HDD), a memory card, or some other rewritable storage medium.

Examples of software programs that run on the PC 110 include a generic image processing application software program (referred to below as an application program) and a printer driver software program (referred to below as a printer driver). The printer control section 111 further includes a dot-formation positioning section 115 in the printer driver, which corresponds to an "adjustment section" herein. The dot-formation positioning section 115 adjusts the relative positions of dots to be created by the movements in first and second scanning directions in the bidirectional printing. Detailed functions of the dot-formation positioning section 115 will be described later.

Figure 2:
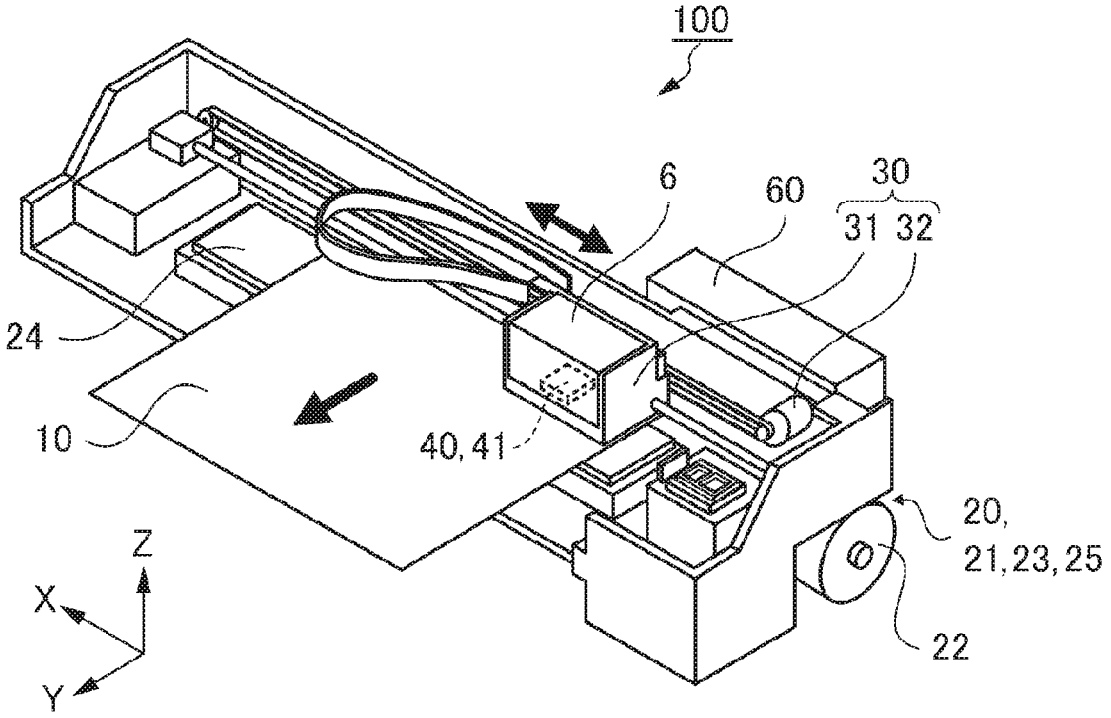
FIG. 2 is a perspective view illustrating an internal configuration of the ink jet printer in the droplet ejecting apparatus in the first embodiment.

FIG. 2 is a perspective view illustrating an internal configuration of the printer 100. In FIG. 2, the printer 100 is placed on the X-Y plane defined by X, Y, and Z coordinates. In the following description, the ±X directions correspond to scanning directions, the +Y direction corresponds to a transport direction, and the +Z direction corresponds to a height direction. Details of the scanning directions and the transport direction will be described later. Herein, the +Y direction corresponds to a "first direction"; ±X directions correspond to "second directions". A basic configuration of the printer 100 will be described below with reference to FIGS. 1 and 2.

Basic Configuration of Ink Jet Printer

The printer 100 includes: a transport unit 20, a carriage unit 30, a head unit 40, and a controller 60; the carriage unit 30 corresponds to a "scanning movement section" herein. When the printer 100 receives print data (image formation data) from the PC 110, the controller 60 controls the transport unit 20, the carriage unit 30, and the head unit 40 in accordance with the received print data to print or form an image on a paper sheet 10. The paper sheet 10 corresponds to a "print medium" herein.

The print data is used to create an image and is in a format that the printer 100 can print. More specifically, the application program and the printer driver in the PC 110 convert typical RGB digital image information obtained from a digital camera or some other imaging device to the print data.

The transport unit 20 moves the paper sheet 10 in a predetermined transport direction (in the +Y direction in FIG. 2, or the first direction). The transport unit 20 includes a paper feeding roller 21, a transport motor 22, a transport roller 23, a platen 24, and a paper ejecting roller 25. The paper feeding roller 21 feeds the paper sheet 10 that has been inserted into the printer 100 through the back side thereof (the side in the −Y direction). The transport roller 23 transports the paper sheet 10 fed by the paper feeding roller 21 to a print area above the platen 24. The platen 24 supports the paper sheet 10 during the printing. The paper ejecting roller 25 ejects the paper sheet 10 to the front side of the printer 100 in the transport direction. All of the paper feeding roller 21, the transport roller 23, and the paper ejecting roller 25 are driven by the transport motor 22.

The carriage unit 30 moves the head 41 in predetermined scanning directions (in the ±X directions in FIG. 2, or the second directions). Details of the head 41 will be described later. The carriage unit 30 includes a carriage 31 and a carriage motor 32. The carriage 31 is movable in the scanning directions and driven by the carriage motor 32. The carriage 31 holds a detachable ink cartridge 6 that contains ink.

The head unit 40 ejects ink onto the paper sheet 10 as liquid droplets, which will be referred to below as "ink droplets". The head unit 40 includes a head 41 having a plurality of nozzles, or a plurality of nozzle rows. The head 41 is mounted in the carriage 31 and moves in the scanning directions together with the carriage 31. The head ejects ink droplets while moving in the scanning directions, creating dot rows (raster lines) on the paper sheet 10 in the scanning directions. The head 41 includes two heads, or a first nozzle group 41A and a second nozzle group 41B. Detailed configuration of the head 41 will be described later.

A technology to eject ink droplets (an ink jet technology) may be piezo technology, for example. In piezo technology, a piezoelectric element exerts a pressure on ink stored in a pressure chamber in accordance with a record information signal. Ink droplets are thereby ejected from liquid ejecting nozzles (referred to below as nozzles) that communicate with the pressure chamber. As a result, an image is recorded.

The controller 60 is a control section that controls the printer 100 and includes an interface section 61, a CPU 62, a memory 63, a unit control section 64, and a drive signal generator 65. The controller 60 alternately repeats an ejecting operation and a transport operation; in the ejecting operation, the head 41 ejects ink droplets while moving in the scanning directions, and in the transport operation, the paper sheet 10 is moved in the transport direction. As a result, an image formed of a plurality of dots is printed on the paper sheet 10. When the printer 100 performs the liquid droplet ejecting operation, the head 41 moves not only in the first scanning direction, which is one of the scanning directions, but also in the second scanning direction, which is opposite to the first scanning direction. In other words, the printer 100 performs bidirectional printing. After the image has been printed on the paper sheet 10, the controller 60 discharges the paper sheet 10 by using the paper ejecting roller 25 that rotates in synchronization with the transport roller 23. In this way, the printing operation is completed.

The dot creating operation (liquid droplet ejecting operation), in which the head 41 ejects ink while moving is also referred to as a "pass". A single pass means dot creation with a single reciprocation in the scanning directions. An operation to eject ink through a nozzle row is referred to as a "shot". With a single shot, a nozzle row formed of a plurality of nozzles arrayed in the transport direction ejects ink droplets, thereby creating dots arrayed in the transport direction.

The interface section 61 allows the printer 100 to transmit data to the PC 110 or to receive data therefrom. The CPU 62 is an arithmetic processor that controls the entire printer 100. The memory 63, which includes RAM, EEPROM, and other memory elements, is a memory medium that provides an area in which programs to be executed by the CPU 62 are stored and a working area in which the programs run. The CPU 62 controls the transport unit 20, the carriage unit 30, and the head unit 40 through the unit control section 64 in accordance with programs stored in the memory 63.

The drive signal generator 65 in the controller 60 includes a first drive signal generator 65A and a second drive signal generator 65B. The first drive signal generator 65A generates a first drive signal to be used to drive the piezo elements of the first nozzle group 41A. Likewise, the second drive signal generator 65B generates a second drive signal to be used to drive the piezo elements of the second nozzle group 41B.

Outline of Process Using Printer Driver

Figure 3:
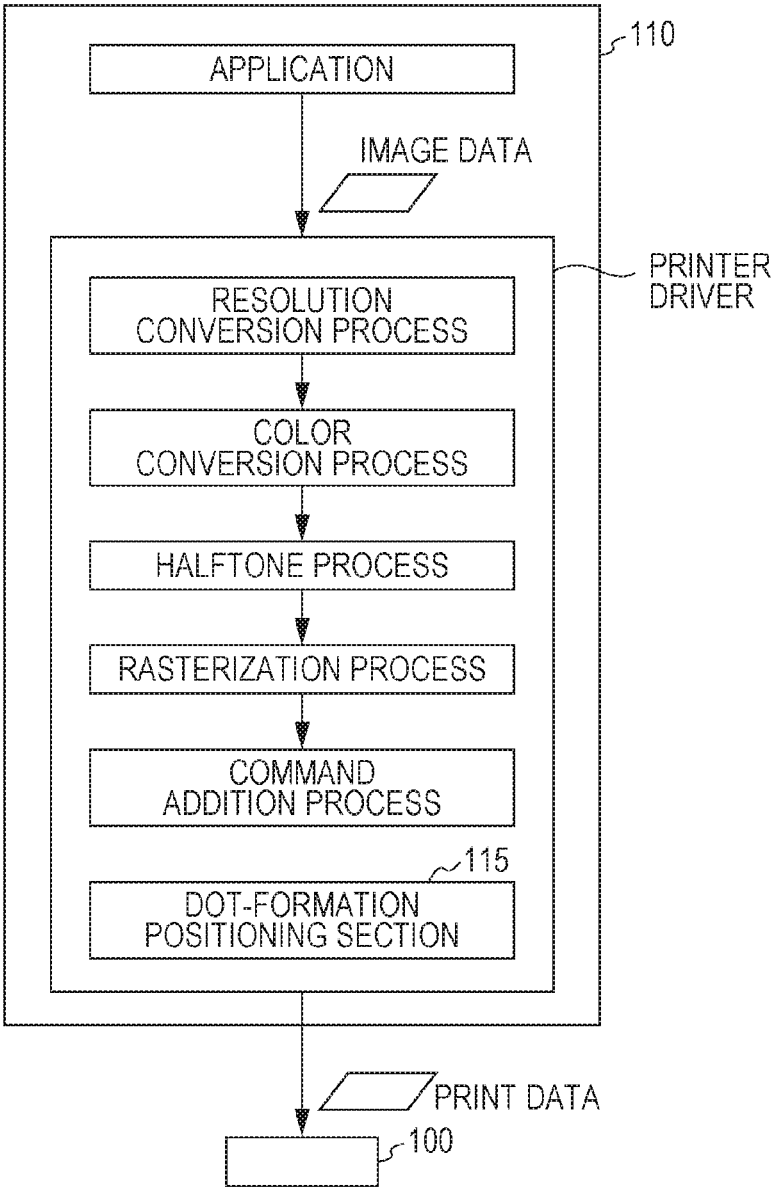
FIG. 3 is a block diagram illustrating a process using the printer driver.

As described above, the foregoing print process is initiated in response to the reception of the print data from the PC 110 connected to the printer 100. This print data is generated by the printer driver. Hereinafter, a process using the printer driver will be described with reference to FIG. 3. FIG. 3 is a block diagram illustrating a process using the printer driver. This printer driver functions as the dot-formation positioning section 115, which features this embodiment. Hereinafter, a basic function of the printer driver will be described below. Details of the dot-formation positioning section 115 will be described later.

When receiving image data or text data from the application program, the printer driver converts the image data to print data in a format that the printer 100 can interpret. Then, the printer driver outputs the print data to the printer 100. Specifically, when converting the image data received from the application program to the print data, the printer driver performs a resolution conversion process, a color conversion process, a halftone process, a rasterization process, a command addition process, and other associated processes.

In the resolution conversion process, the resolution of the image data output from the application program is converted to the resolution (print resolution) of image data to be printed on a paper sheet. If the print resolution is set to 720×720 dpi, for example, image data in a vector format that has been received from the application program is converted to image data in a bitmap format having a resolution of 720×720 dpi. The pixel data of the image data that has been subjected to the resolution conversion process is formed of pixels arranged in a matrix fashion. For example, each pixel has a tone value of 256 gradations in an RGB color space. Thus, the pixel data that has been subjected to the resolution conversion indicate tone values in pixels. Herein, the pixel data concerning pixels arrayed in a single row in a predetermined direction, which are a part of pixels arranged in a matrix fashion, will be, in some cases, referred to as "raster data". The predetermined direction in which pixels in the raster data are arrayed corresponds to the directions (scanning directions) in which the head 41 moves while printing an image.

In the color conversion process, the RGB data is converted to CMYK color space data. The CMYK colors are cyan (C), magenta (M), yellow (Y), and black (K). The CMYK color space image data conforms to the colors of inks in the printer 100. If the printer 100 uses ten different inks in a CMYK color space, the printer driver generates image data in ten dimensions of the CMYK color space from the RGB data. The color conversion process is based on a color conversion table called a lookup table (LUT) in which tone values in the RGB data correspond to tone values in the CMYK color data. The pixel data that has been subjected to the color conversion process is CMYK color data of 256 gradations expressed in the CMYK color space.

In the halftone process, data with a large number of (256) gradations is converted to data with a number of gradations that the printer 100 can support. For example, in the halftone process, data with 256 gradations is converted to 1-bit data with 2 gradations or 2-bit data with 4 gradations. Thus, the image data that has been subjected to the halftone process is 1-bit or 2-bit data, and this pixel data is data concerning the creation of dots in pixels, for example, whether dots in pixels are created and the sizes of dots in pixels if the dots are created. If the image data is 2-bit data, or data of 4 gradations, for example, the image data is converted to one of the four dot tone values [00], [01], [10], and [11]; the dot tone value [00] indicates that no dot is to be created, the dot tone value [01] indicates that a small-sized dot is to be created, the dot tone value [10] indicates that a medium-sized dot is to be created, and the dot tone value [11] indicates that a large-sized dot is to be created. Then, a generation ratio of dots of each size is determined, and pixel data is generated by a dither method, a γ correction, an error diffusion method, and other image processing methods so that the printer 100 creates dots in a dispersed manner.

In the rasterization process, the pieces of data concerning dots in pixels arranged in a matrix fashion are rearranged in the order in which dots are to be created upon printing. If multiple processes of creating dots are performed separately upon printing, for example, a process of extracting the pieces of pixel data corresponding to the dots and a process of rearranging the pieces of pixel data in the order in which the dots are to be created may be performed. The rasterization process may depend on a printing method to be employed, because print methods have different orders of dot creation.

In the command addition process, command data based on a print scheme is added to the data that has been subjected to the rasterization process. For example, the command data may be transport data indicating the transport speed of a medium.

The print data that has been generated through the above processes is transmitted from the printer driver to the printer 100.

Configuration of Head

Figure 4:
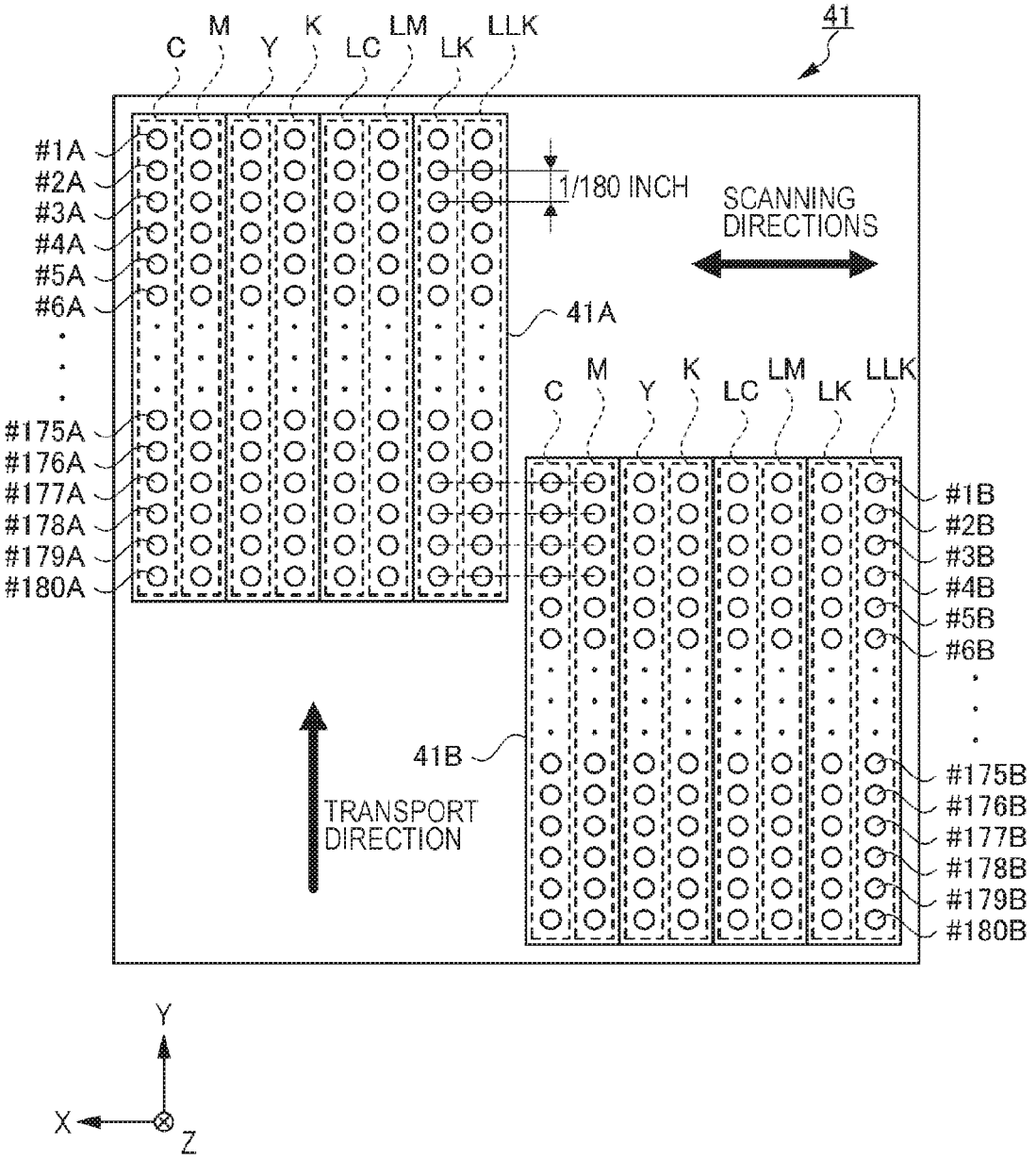
FIG. 4 illustrates exemplary nozzle rows.

FIG. 4 illustrates exemplary nozzle rows in the head 41. The head 41 is provided with the first nozzle group 41A and the second nozzle group 41B as two heads (nozzle groups). Each nozzle group has eight nozzle rows with their ejection holes opened on the bottom surface of the head 41. The eight nozzle rows eject dark cyan (C), dark magenta (M), yellow (Y), dark black (K), light cyan (LC), light magenta (LM), light black (LK), and ultra-light black (LLK) inks.

In each nozzle row, for example, 180 nozzles (with nozzles #1A to #180A or #1B to #180B) are arrayed in a predetermined direction intersecting the scanning directions at regular intervals corresponding to 180 dpi. In this embodiment, the predetermined direction may be the transport direction (first direction). In FIG. 4, a smaller number is assigned to a nozzle disposed closer to the downstream side (+Y side) in the transport direction.

The first nozzle group 41A is disposed downstream of the second nozzle group 41B in the transport direction. Further, the first nozzle group 41A and the second nozzle group 41B are disposed with respective four nozzles overlapping each other in the transport direction. For example, the nozzles #177A in the first nozzle group 41A are disposed at the same location in the transport direction as the nozzles #1B in the second nozzle group 41B. Thus, when the nozzles #177A in the first nozzle group 41A can create dots for certain pixels during the liquid droplet ejecting operation, the nozzle #1B in the second nozzle group 41B can also create dots for the same pixels. A combination of nozzle rows in the first nozzle group 41A and the second nozzle group 41B which eject the same ink, or inks having the same composition, is referred to as a "head set".

Figure 5:
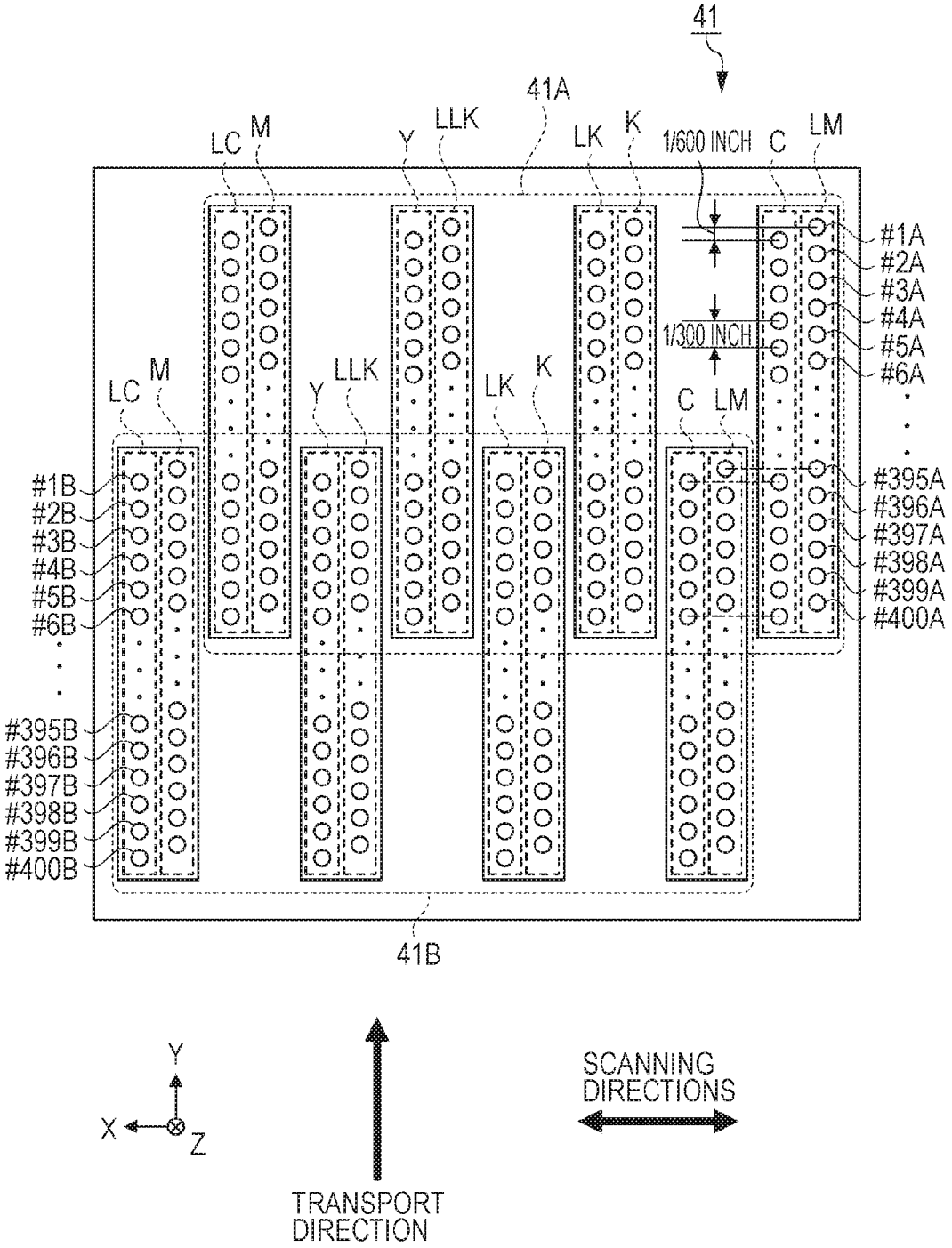
FIG. 5 illustrates other exemplary nozzle rows.

FIG. 5 illustrates other exemplary nozzle rows in the head 41. In the example of FIG. 5, the head sets in FIG. 4 are disposed closer to each other. More specifically, in the example of FIG. 5, nozzle row pairs in the first nozzle group 41A and the second nozzle group 41B are disposed in a staggered fashion. In each nozzle row, for example, 400 nozzles (nozzles #1A to #400A or #1B to #400B) are arrayed in the transport direction at regular intervals corresponding to 300 dpi. In addition, the nozzle rows in each nozzle row pair are disposed while being shifted by ½ intervals (1/600 inches).

The first nozzle group 41A and the second nozzle group 41B are disposed with respective six nozzles overlapping each other in the transport direction. For example, the nozzles #395A in the first nozzle group 41A are disposed at the same location in the transport direction as the nozzles #1B in the second nozzle group 41B. In other words, the nozzles #395A in the first nozzle group 41A are disposed so as to overlap the nozzles #1B in the second nozzle group 41B in the scanning directions (second directions). Thus, when the nozzles #395A in the first nozzle group 41A can create dots for certain pixels during the liquid droplet ejecting operation, the nozzle #1B in the second nozzle group 41B can also create dots for the same pixels.

Figure 6:
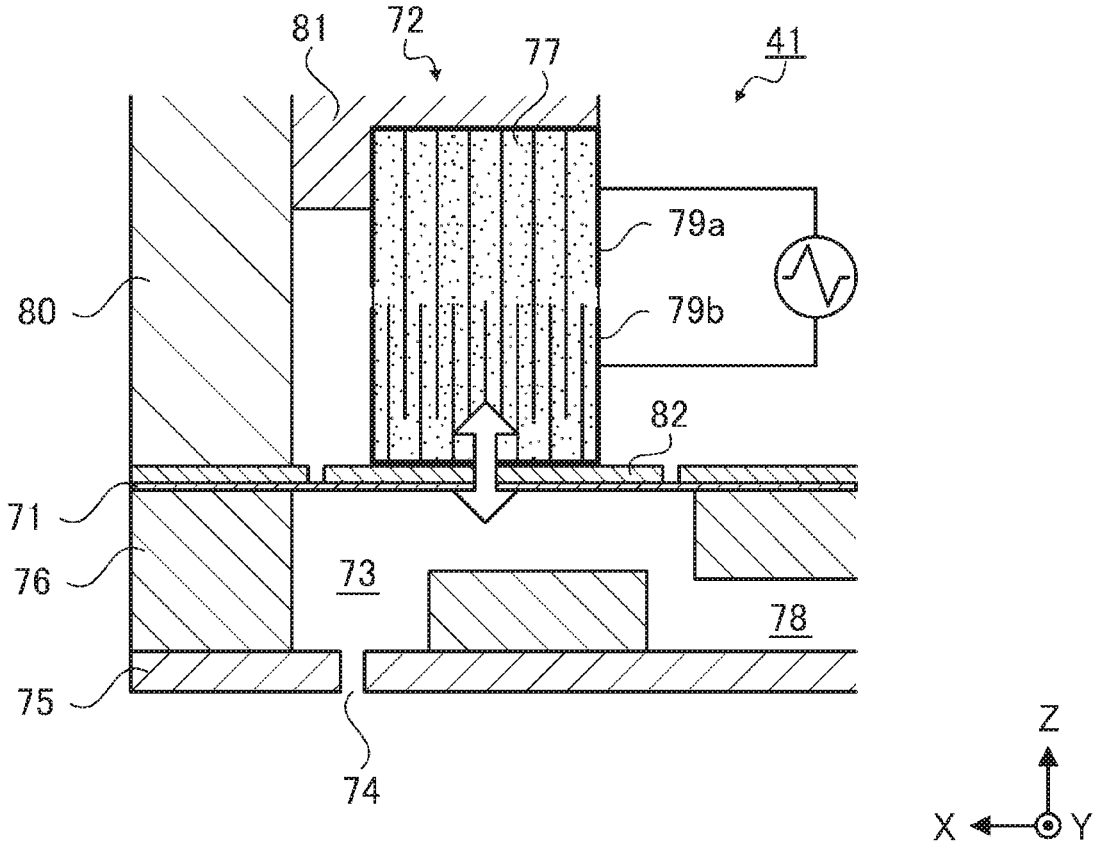
FIG. 6 is a sectional view illustrating the nozzles and their peripheral components.

FIG. 6 is a sectional view illustrating the nozzles in the head 41 and their peripheral components. Specifically, FIG. 6 schematically illustrates a structure in the vicinity of a single nozzle 74. The head 41 includes a vibration plate 71. A piezoelectric actuator 72 displaces the vibration plate 71. A cavity (pressure chamber) 73 is filled with ink, and its inner pressure depends on the displacement of the vibration plate 71. The nozzle 74 communicates with the cavity 73, and the ink is ejected in droplet form through the nozzle 74 in response to a change in the inner pressure of the cavity 73. The nozzle 74 is formed in the nozzle plate 75. The cavity 73 and a reservoir 78 that communicate with each other are formed by the nozzle plate 75, the vibration plate 71, and a cavity substrate 76 disposed between the nozzle plate 75 and the vibration plate 71. The reservoir 78 communicates with the ink cartridge 6 (see FIG. 2) through an ink passage (not illustrated).

The piezoelectric actuator 72 includes electrodes 79*a* and 79*b* and piezoelectric elements 77. Each of the electrodes 79*a* and 719*b* has members disposed in a comb-like fashion which face each other. The piezoelectric elements 77 and the comb-like members of the electrodes 79*a* and 79*b* are alternately disposed. As illustrated in FIG. 6, a first end of the piezoelectric actuator 72 is fixed to a fixed plate 81 secured to a casing 80 of the head 41, whereas a second end of the piezoelectric actuator 72 is bonded to the vibration plate 71 with a joint plate 82 therebetween. When a drive signal is applied between the electrodes 79*a* and 79*b* in the piezoelectric actuator 72 configured above, the vibration plate 71 vibrates in the directions indicated by the arrow in FIG. 6, thereby changing the inner pressure of the cavity 73. In response to the changing in the inner pressure of the cavity 73, ink droplets are ejected through the nozzle 74.

Ejection Location Adjusting Method in Related Art

To perform bidirectional printing in which liquid droplet ejecting operations are carried out not only by the movement in the first scanning direction, which is one of the scanning directions, but also by the movement of the second movement, which is opposite to the first scanning direction, it is necessary to adjust highly precisely the relative position of dots to be created, namely, the relative position at which ink droplets are to be placed on a paper sheet. First, a method of adjusting dots to be created (bid adjustment) will be described.

Figure 7:
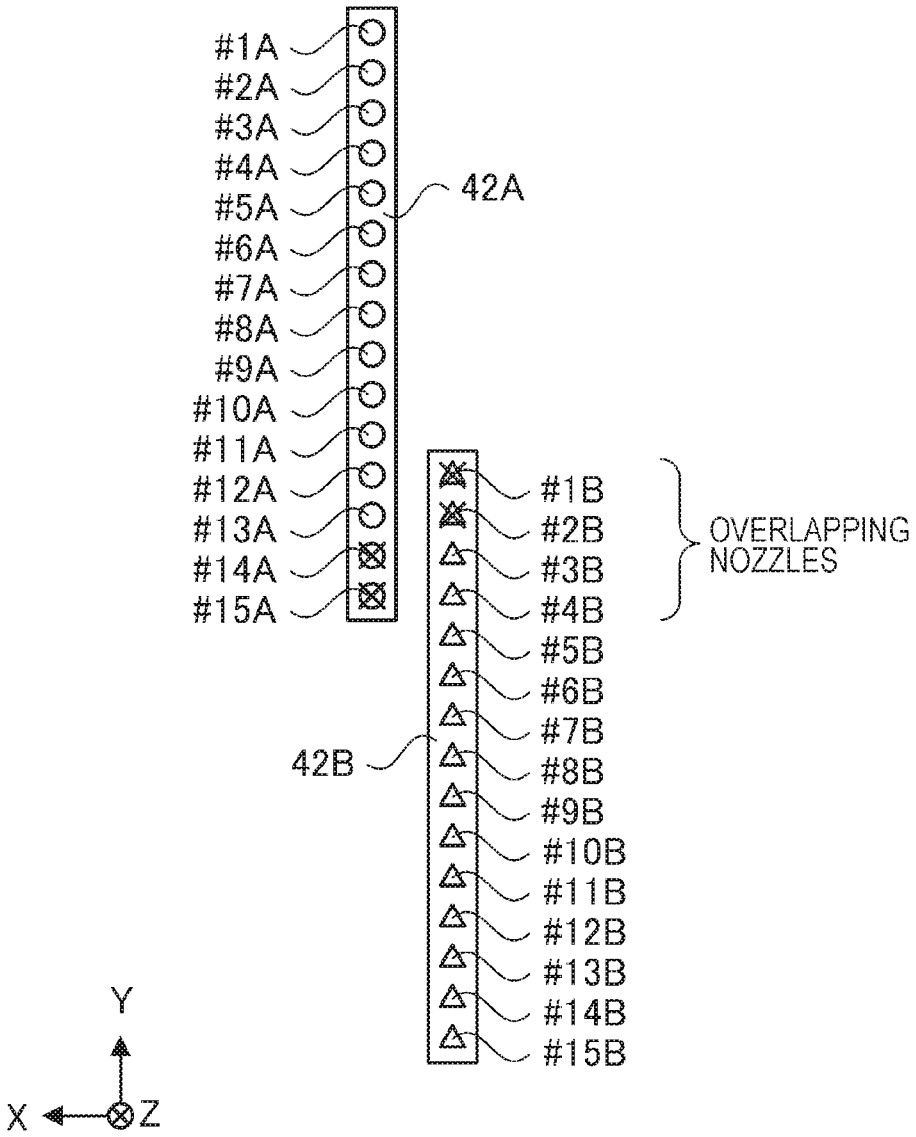
FIG. 7 illustrates a head set used in a discharge position adjusting method.

FIG. 7 illustrates a head set used in a discharge position adjusting method. As illustrated in FIG. 7, for the sake of easing the following description, a head set in the head 41 has a pair of nozzle rows, each of which is provided with fifteen nozzles. The head set illustrated in FIG. 7 has a nozzle row 42A for a color ink (e.g., black (K) ink) in the first nozzle group 41A and a nozzle row 42B for the same color ink (black (K) ink) in the second nozzle group 41B. Herein, the nozzle row 42A corresponds to a "first nozzle row", and the nozzle row 42B corresponds to a "second nozzle row". The first nozzles #15A in the nozzle row 42A on the upstream side (the side in the −Y direction) overlaps, in the transport direction, the fourth nozzle #4B in the nozzle row 42B on the downstream side (the side in the +Y direction). Likewise, the second nozzle #14A in the nozzle row 42A overlaps the third nozzle #3B in the nozzle row 42B. The third nozzle #13A in the nozzle row 42A overlaps the second nozzle #2B in the nozzle row 42B. The fourth nozzle #12A in the nozzle row 42A overlaps the first nozzle #1B in the nozzle row 42B. Hereinafter, these four nozzles in each nozzle row are referred to as overlapping nozzles.

The printer 100 adjusts the positions of dots to be created such that dots to be created by the movement in the first scanning direction are shifted evenly from dots to be created by the movement in the second scanning direction. More specifically, first, the dot-formation positioning section 115 (see FIG. 3), which is a function of the printer driver, prints an image (adjustment pattern) indicating how evenly dots created by the movement in the first scanning movement are shifted from dots created by the movement in the second scanning movement. Then, a correction is determined on the basis of the uneven shift identified on the basis of the image and input to the PC 110. The PC 110 transmits the corrected print data to the printer 100. The printer driver controls the print operation of the printer 100 such that dots are created at locations corrected on the basis of the recognized uneven shift. To determine whether the correction is acceptable, the printer 100 prints an adjustment pattern (check pattern) based on the correction. If the correction is unacceptable, the above process is repeated.

Figure 8A:
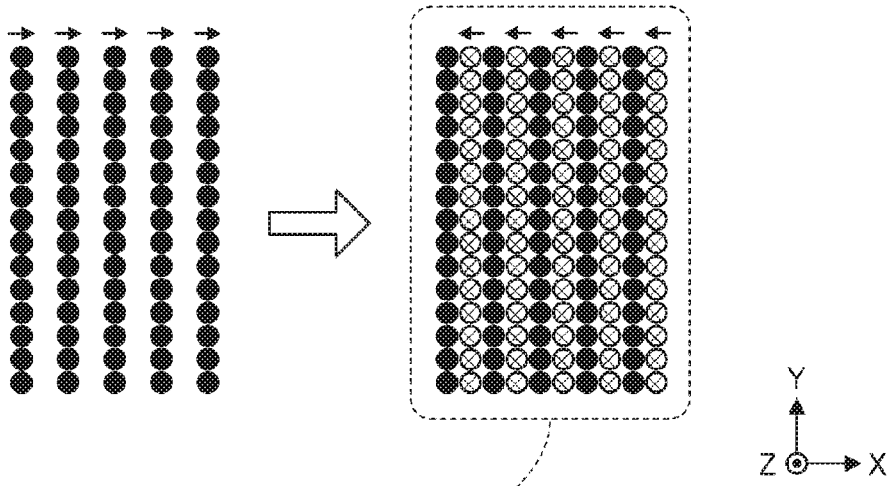
FIGS. 8A, 8B, and 8C are conceptual diagrams illustrating an adjustment pattern(s) in the related art, which is used to adjust the positions of dots to be created.
Figure 8B:
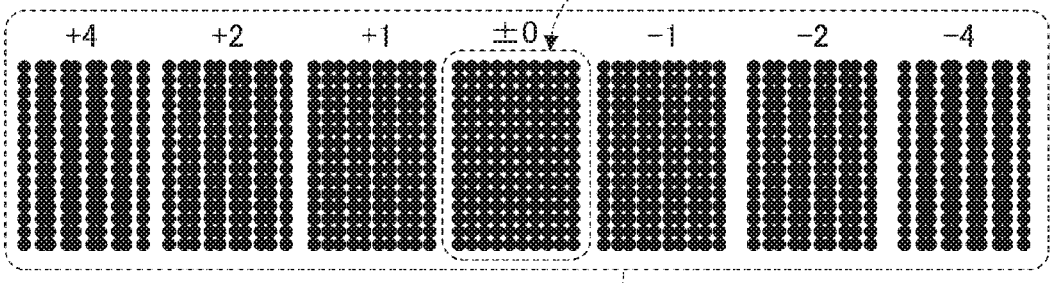
Figure 8C:
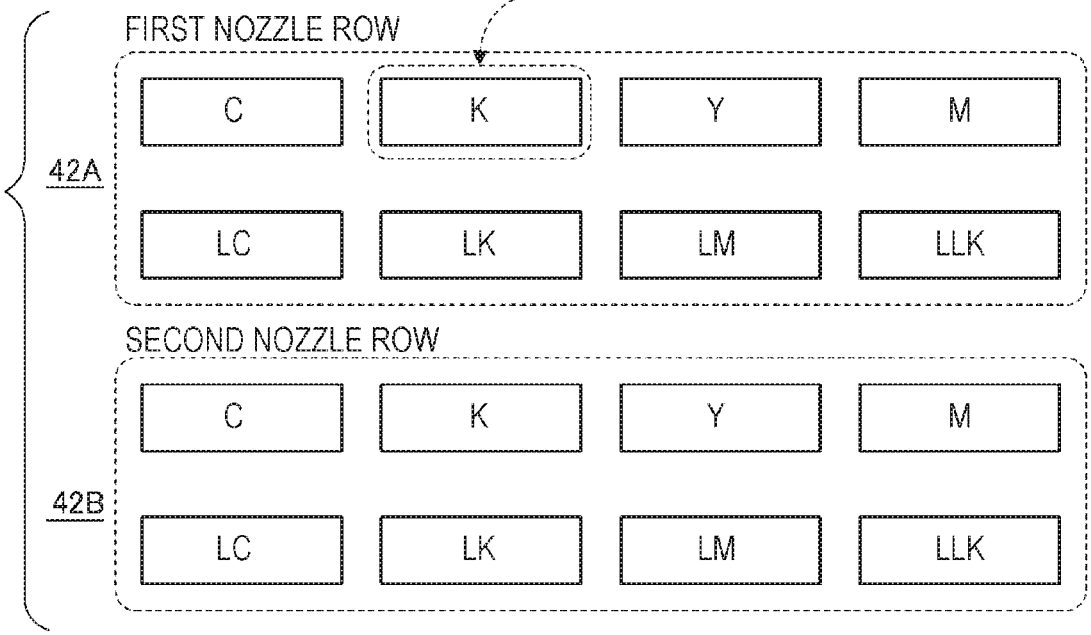

FIGS. 8A, 8B, and 8C are conceptual diagrams illustrating an adjustment pattern in the related art which is used to adjust the positions of dots to be created. FIG. 8A conceptually illustrates dot rows created when the nozzle row 42A moves in both the first and second scanning directions; each of the dot rows is formed of fifteen dots arrayed in the first direction (+Y direction). As illustrated in the left-hand part of FIG. 8A, first, when the nozzle row 42A moves in the first scanning direction, a plurality of dot rows are created on a medium with intervals therebetween; each interval having a width nearly equal to the diameter of a dot. These dot rows correspond to five dot rows formed of solid circles illustrated in FIG. 8A. In turn, as illustrated in the right-hand part of FIG. 8A, when the nozzle row 42A moves in the second scanning direction, a plurality of dot rows are further created so as to fill the intervals. Exceptionally, the rightmost dot row is created next to the rightmost dot row that has already been created. These dot rows correspond to five dot rows formed of shaded circles illustrated in FIG. 8A. Herein, a plurality of dot rows created by the movement in the first scanning direction is referred to as first dot rows; a plurality of dot rows created by the movement in the second scanning direction is referred to as second dot rows. Thus, the adjustment pattern is formed of dots created by the movements in the first and second scanning directions.

When the dot rows are created in the above manner, the dots created by the movement in the first scanning direction may be shifted unevenly from the dots created by the movement in the second scanning direction. This uneven shift can be visually perceived as an uneven interval between the dot rows. Instead of the visually perception, the uneven shift may be detected with an optical image process. By performing a process of minimizing uneven shift between dots created when the head 41 moves in the first and second scanning directions, the positions of dots to be created can be adjusted.

FIG. 8B illustrates an exemplary adjustment pattern for a single nozzle row. An adjustment pattern is a dedicated image prepared to adjust effectively the positions of dots to be created. The data used to print an adjustment pattern may be stored in advance in the memory section 114 of the PC 110. The exemplary adjustment pattern in FIG. 8B includes seven blocks, which correspond to the pattern in the right-hand part of FIG. 8A. Of the seven blocks, the central block is created with no correction, the first to third blocks on the left side are created with three different corrections (shifts) on the positive side, and the first to third blocks on the right side are created with three different corrections on the negative side. For example, if the resolution is 1/1200 inches, the correction "+4" indicates that dots created by the movement in the second scanning direction are shifted in the +X direction from dots created by the movement in the first scanning direction by 4/1200 inches. In the example of FIG. 8B, the dots are arrayed evenly in the central block of the correction ±0. Therefore, no correction is required for this example.

FIG. 8C illustrates exemplary adjustment patterns printed on the paper sheet 10. All the nozzle rows need to be subjected to a process of adjusting the positions of dots to be created. Therefore, nozzle rows 42A and nozzle rows 42B for the respective colored inks each print the adjustment patterns illustrated in FIG. 8B. In the example of FIG. 8C, the nozzle rows 42A for cyan (C), black (K), yellow (Y), and magenta (M) inks print the adjustment patterns on the first text line. The nozzle rows 42A for light cyan (LC), light black (LK), light magenta (LM), and ultra-light black (LLK) inks print the adjustment patterns on the second text line. Likewise, the nozzle rows 42B for eight colored inks print adjustment patterns on the third and fourth text line. The process of adjusting the positions of dots to be created is performed in nozzle rows, on the basis of adjustment patterns actually printed as illustrated in FIG. 8C.

Dots making up an adjustment pattern may have one of large, medium, and small sizes, as described above. In this embodiment, however, all the dots have a medium size, for the sake of easing the description.

Figure 9:
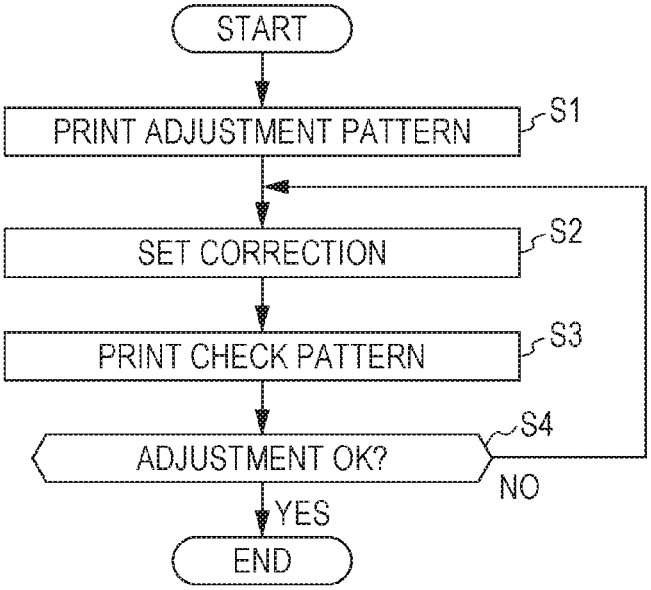
FIG. 9 is a flowchart of a process of adjusting the positions of dots to be created.
Figure 10A:
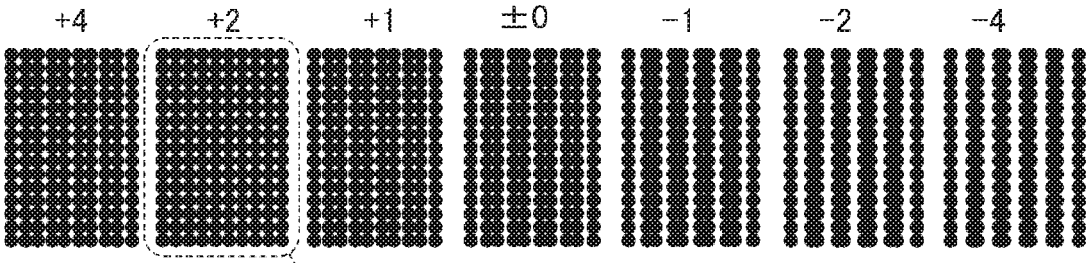
FIGS. 10A and 10B illustrate adjustment patterns created before the process of adjusting the positions of dots to be created is performed.

FIG. 9 is a flowchart of the process of adjusting the positions of dots to be created. This process is performed by the dot-formation positioning section 115. The dot-formation positioning section 115 is activated by the printer driver. Once activated, the dot-formation positioning section 115 performs the process of adjusting the positions of dots to be created. At Step S1, first, the dot-formation positioning section 115 prints adjustment patterns. Exemplary adjustment patterns are illustrated in illustrated in FIG. 8C. FIG. 10A illustrates an exemplary adjustment pattern printed by a single nozzle row (e.g., the nozzle row 42A for a black (K) ink).

At Step S2, a printed adjustment pattern is checked, and then a necessary correction is determined and set. A description will be given regarding an exemplary case where the image illustrated in FIG. 10A is used as the printed adjustment pattern. In this case, the uneven shift between dots created by the movements in the first and second scanning directions is visually perceived from the block of the correction ±0. In addition, the even shift is visually perceived from the block of the correction +2. Basically, as illustrated in FIG. 8B, dots are expected to be arrayed evenly in the block of the correction ±0, but in this case, dots created by the movements in the first and second scanning directions are shifted unevenly in the block of the correction ±0. Instead, dots are arrayed evenly in the block of the correction+2. This means that since dots created by the movements in the first and second scanning directions are excessively shifted from one another in the −X direction by 2/1200, the dots are arrayed evenly in the block of the correction+2. Thus, it is necessary to make a correction of displacing dots to be created by the movement in the second scanning direction by 2/1200 inches in the +X direction.

At Step S2, the correction+2 is input to the dot-formation positioning section 115. More specifically, the dot-formation positioning section 115 obtains the correction +2 that the input section 112 has received through a correction input screen displayed by the display section 113.

Figure 10B:
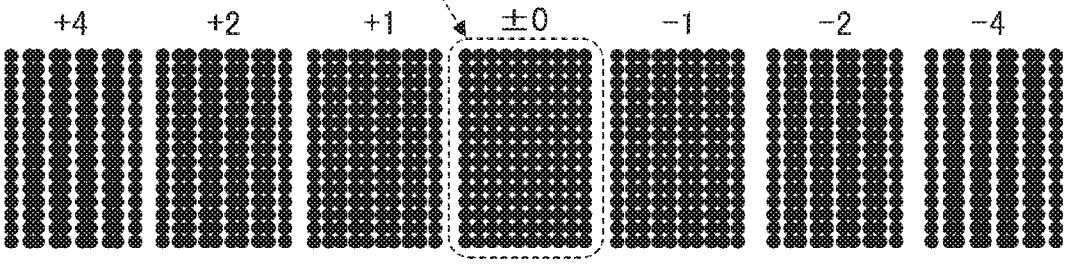

After the correction has been set, the printer driver prints a check pattern at Step S3. The printed check pattern is similar to the adjustment pattern. In this case, the relative position of dots created by the movements in the first and second scanning directions has been corrected by the dot-formation positioning section 115. Therefore, a corrected adjustment pattern is printed as the check pattern. FIG. 10B illustrates an exemplary printed check pattern. If the positions of dots to be created have been corrected appropriately, dots can be arrayed evenly in the block of correction ±0.

At Step S4, it is checked whether dots are arrayed evenly in the block of correction ±0 in the check pattern. If dots arrayed unevenly are visually perceived ("NO" at Step S4), the processing returns to Step S2, and a new correction will be set. If it is checked that dots are arrayed evenly in the block of correction ±0 in the check pattern ("YES" at Step S4), dots created by the movements in the first and second scanning directions are determined to be disposed at appropriate positions. Therefore, the process of adjusting the positions of dots to be created has been completed.

As described above, in the related art, adjustment patterns are printed individually in nozzle rows, namely, the nozzle rows 42A and 42B for respective colored inks (see FIG. 8C). More specifically, an image created by the nozzle rows 42A (e.g., an image having eight blocks on the first and second text lines in FIG. 8C) is printed independently of an image created by the nozzle rows 42B (e.g., an image having eight blocks on the third and fourth text lines in FIG. 8C). In short, the related art is based on a precondition that adjustment patterns are formed by all the nozzles of nozzle rows, including overlapping nozzles.

Discharge Position Adjusting Method in First Embodiment

Next, a discharge position adjusting method in this embodiment will be described. A "first image" used herein refers to an image created by the first nozzle row (nozzle row 42A), which indicates the state of the adjustment made by the dot-formation positioning section 115. In the exemplary related art described above, the image that is created by the nozzle row 42A and includes the eight blocks on the first and second rows in FIG. 8C corresponds to the first image. A "second image" used herein refers to an image created by the second nozzle row (nozzle row 42B), which indicates the state of the adjustment made by the dot-formation positioning section 115. In the exemplary related art described above, the image that is created by the nozzle row 42B and includes the eight blocks on the third and fourth rows in FIG. 8C corresponds to the second image. In contrast to the related art described above, this embodiment features the creation of the first image and the second image through a single liquid droplet ejecting operation, or through the same pass. Further, the first image and the second image are created successively in the first direction.

Figure 11:
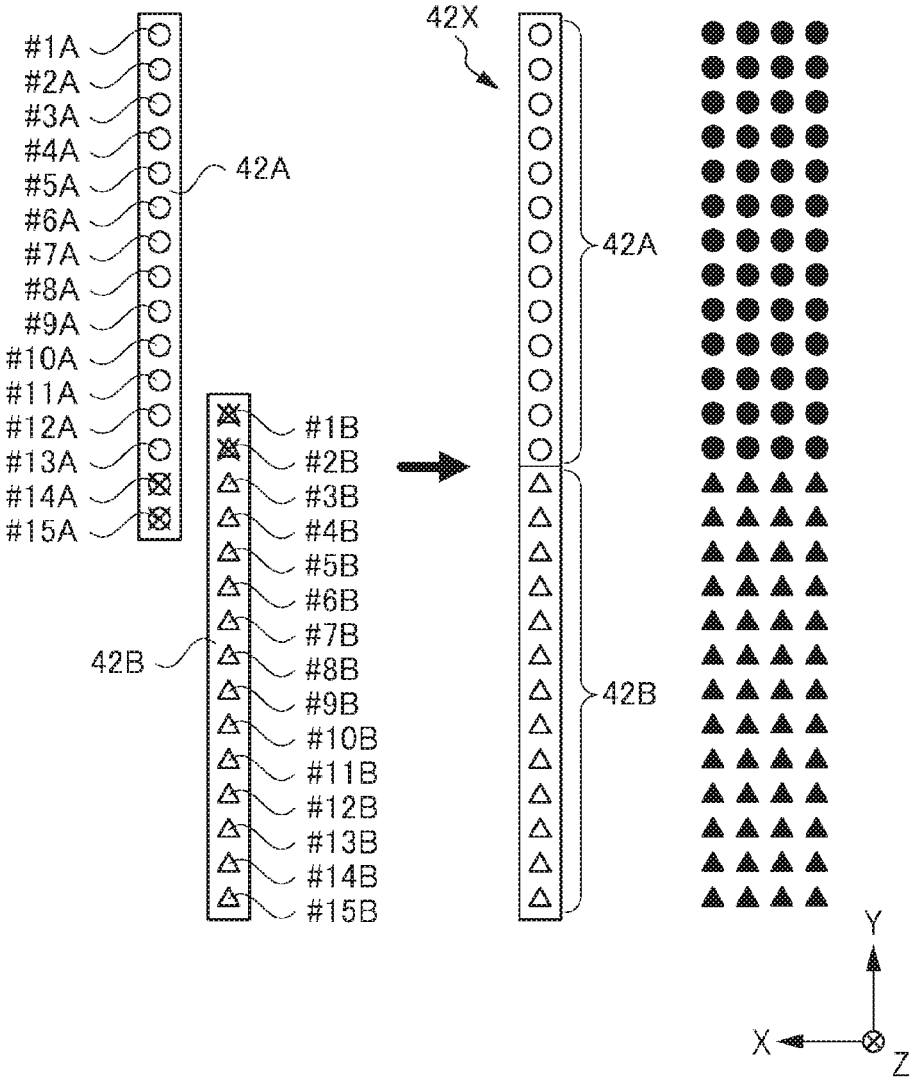
FIG. 11 is a conceptual diagram illustrating a virtual head.

If the head set (see FIG. 7) described in the related art is regarded as a single virtual head (nozzle row), this embodiment can be understood easily. FIG. 11 is a conceptual diagram illustrating a virtual head. As illustrated in the right-hand part of FIG. 11, the two heads (nozzle rows 42A and 42B) constituting the head set of FIG. 7 (head set in the left-hand part of FIG. 11) can be regarded as a single virtual head 42X. In this case, only the overlapping nozzles (see FIG. 7) that eject ink are considered. In other words, the overlapping nozzles with an "X" mark which do not eject ink are ignored. In addition, the timing at which the nozzles eject ink is controlled. Consequently, the nozzle rows 42A and 42B can be regarded as a single nozzle row that continuously extend in the first direction. Therefore, as illustrated in the right-hand part of FIG. 11, the virtual head 42X can create dot rows on its right side, each of which is formed of twenty six dots. Each dot row includes a first dot row and a second dot row that continuously extend; the first dot row is formed of thirteen solid-circular dots created by the nozzle row 42A (first nozzle row), and the second dot row is formed of thirteen solid-triangular dots created by the nozzle row 42B (second nozzle row).

Figure 12A:
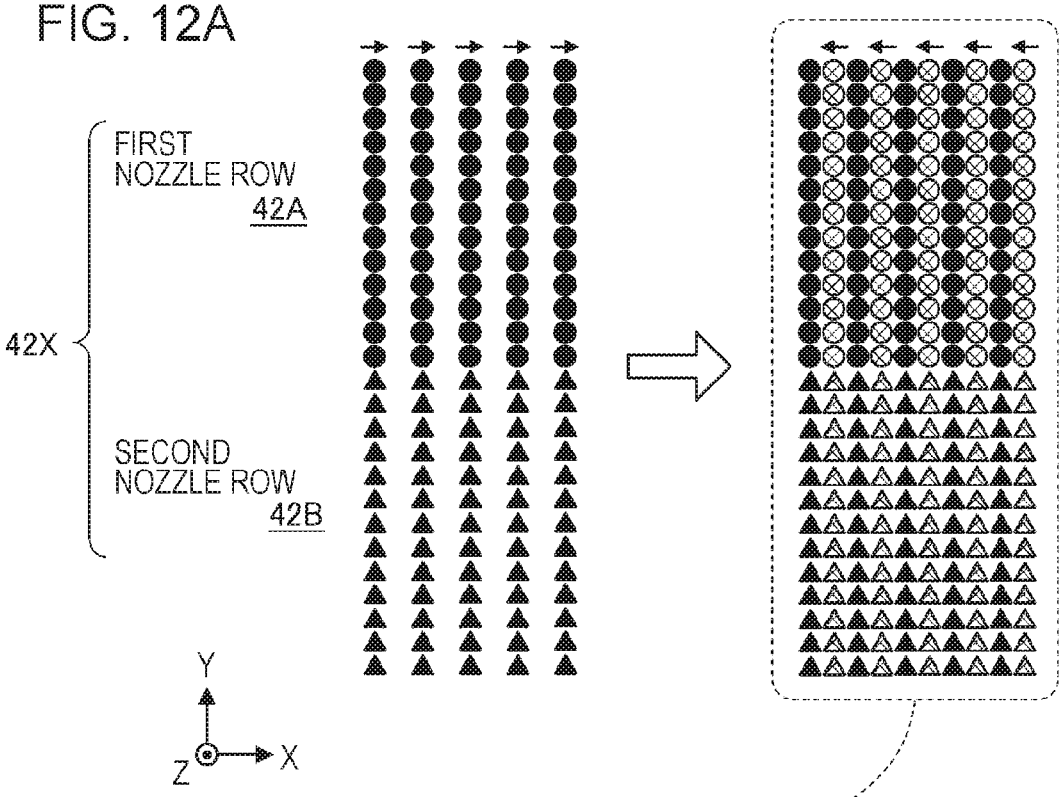
FIGS. 12A and 12B are conceptual diagrams illustrating a process, in the first embodiment, for adjusting the positions of dots to be created.

FIGS. 12A, 12B, 13A, and 13B are conceptual diagrams each illustrating an adjustment pattern(s), which is used to adjust the positions of dots to be created in this embodiment. FIG. 12A conceptually illustrates dot rows created by the movements of the virtual head 42X in the first and second scanning directions; each of the dot rows is formed of twenty six dots arrayed in the first direction. As illustrated in the left-hand part of FIG. 12A, first, when moving in the first scanning direction, the virtual head 42X creates a plurality of dot rows (five dot rows in the left-hand part of FIG. 12A) with intervals therebetween; each interval has a width nearly equal to the diameter of a dot. Then, as illustrated in the right-hand part of FIG. 12A, when moving in the second scanning direction, the virtual head 42X creates a plurality of dot rows (five dot rows in the right-hand part of FIG. 12A) so as to fill the intervals. Exceptionally, the rightmost dot row is created next to the rightmost dot row that has already been created.

In short, the first image created by the nozzle row 42A and the second image created by the nozzle row 42B, which indicate the state of the adjustment made by the dot-formation positioning section 115, are created through a single liquid droplet ejecting operation, or through the same pass.

Figure 12B:
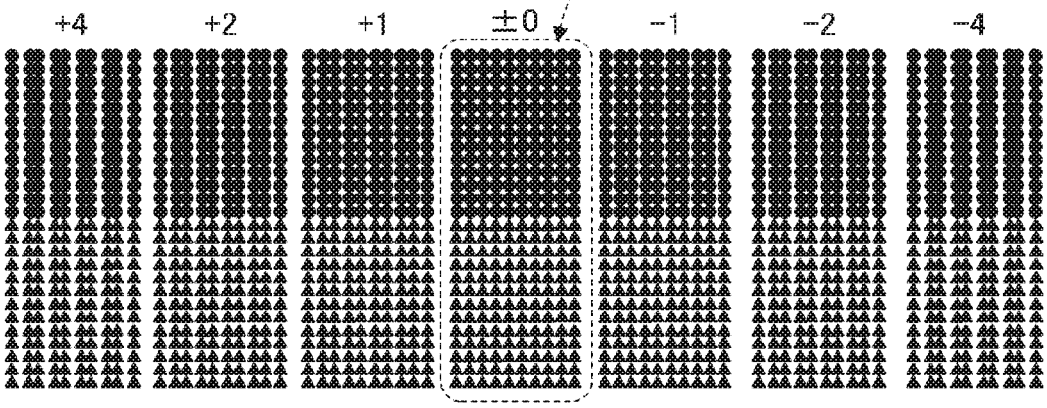

FIG. 12B illustrates an exemplary adjustment pattern created by a single virtual head 42X. This adjustment pattern is a dedicated image prepared to adjust effectively the positions of dots to be created, similar to the adjustment pattern in the related art described above. The data used to print the adjustment pattern may be stored in advance in the memory section 114 of the PC 110. The exemplary adjustment pattern in FIG. 12B includes seven blocks, similar to the related art, and these blocks correspond to the pattern in the right-hand part of FIG. 12A. Of the seven blocks, the central block is created with no correction, the first to third blocks on the left side are created with three different corrections (shifts) on the positive side, and the first to third blocks on the right side are created with three different corrections on the negative side.

Figure 13A:
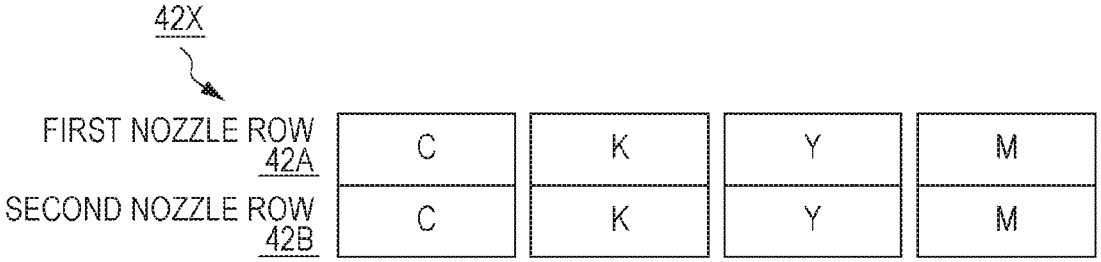
FIGS. 13A and 13B are conceptual diagrams illustrating the process, in the first embodiment, for adjusting the positions of dots to be created.
Figure 13B:
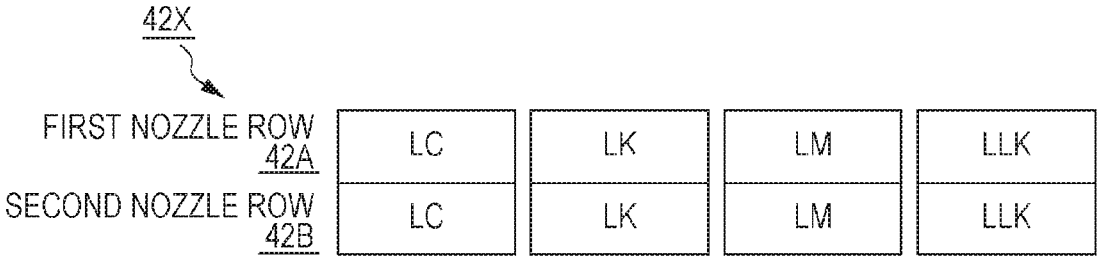

FIGS. 13A and 13B illustrate exemplary adjustment patterns printed on the paper sheet 10. Since all the nozzle rows need to be subjected to a process of adjusting the positions of dots to be created, the adjustment patterns, as illustrated in FIG. 12B, are printed in virtual heads 42X for respective colored inks. In the examples of FIGS. 13A and 13B, the adjustment patterns are printed on the first text line by virtual heads 42X for cyan (C), black (K), yellow (Y), magenta (M) inks. The adjustment patterns are printed on the second text line by virtual heads 42X for light cyan (LC), light black (LK), light magenta (LM), ultra-light black (LLK) inks. The individual nozzle rows are subjected to the process of adjusting the positions of dots to be created, on the basis of the adjustment patterns illustrated in FIGS. 13A and 13B.

Figure 14A:
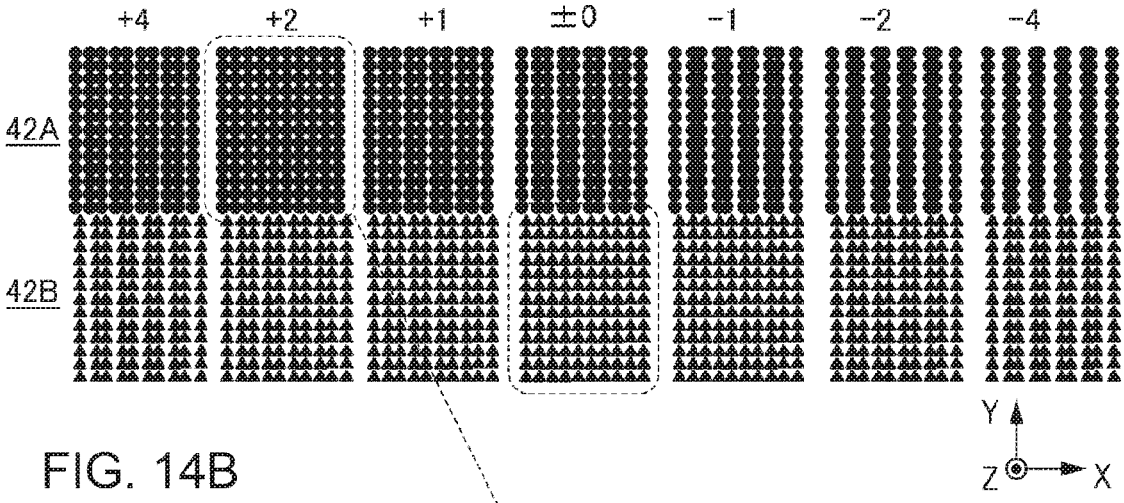
FIGS. 14A, 14B, and 14C illustrate adjustment patterns created before and after the process of adjusting the positions of dots to be created is performed.
Figure 14B:
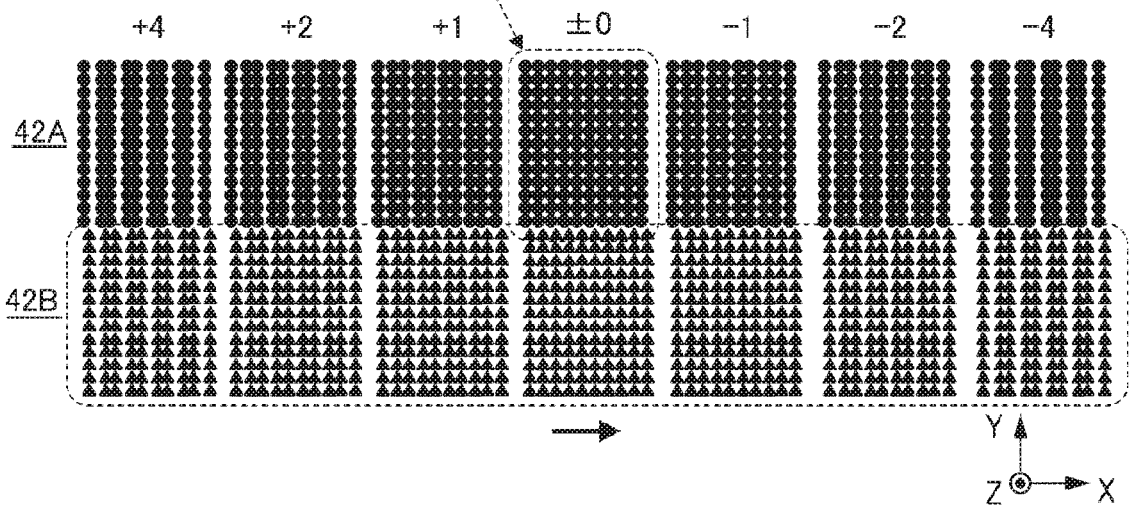
Figure 14C:
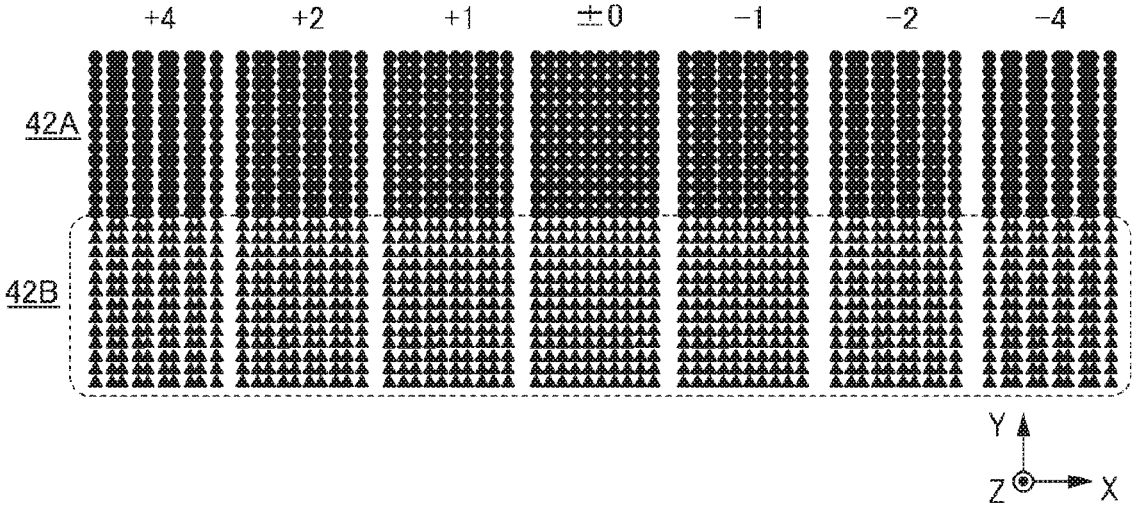

The flow of the process of adjusting the positions of dots to be created is substantially the same as the flow of the process in the flowchart illustrated in FIG. 9, aside from adjustment patterns used. In this embodiment, the adjustment patterns illustrated in FIGS. 13A and 13B are used. FIGS. 14A, 14B, and 14C illustrate exemplary adjustment patterns created before and after the process of adjusting the positions of dots to be created is performed. FIG. 14A illustrates an exemplary adjustment pattern that is printed by a single virtual head 42X (e.g., nozzle rows 42A and 42B for a black (K) ink) before the process of adjusting the positions of dots to be created is performed. In this example, the dots created by the movements of the nozzle row 42A in the first and second scanning directions are arrayed unevenly in the block of the correction ±0, but the dots are arrayed evenly in the block of the correction+2. The dots created by the movement of the nozzle row 42B in the first and second scanning directions are arrayed evenly in the block of the correction ±0. In this case, the dots created by the movement of the nozzle row 42A in the second scanning direction are excessively shifted from the dots created by the movement of the nozzle row 42A in the first scanning direction by $2/1200$ inches in the −X direction. However, the dots created by the movements of the nozzle row 42B in the first and second scanning directions are shifted evenly from one another. As a result, a correction in which dots to be created by the movement in the second scanning direction is displaced by $2/1200$ in the +X direction is required for the nozzle row 42A.

FIG. 14B illustrates an exemplary resultant adjustment pattern printed by the nozzle rows 42A and 42B after the relative positions of dots to be created by the movement in the first and second scanning directions have been corrected. In FIG. 14B, the dots created by the nozzle row 42A are misaligned with the dots created by the nozzle row 42B. More specifically, the dots created by the nozzle row 42B are shifted in the +X direction from the dots created by the nozzle row 42A. In this case, the nozzle row 42B is corrected such that both the positions of dots to be created by the movements of the nozzle row 42B in the first and second scanning directions are displaced by the same amount in the same direction. More specifically, the correction is made such that both the positions of dots to be created by the movements of the nozzle row 42B in the first and second scanning directions are displaced by $2/1200$ inches in the −X direction. FIG. 14C illustrates an exemplary resultant adjustment pattern printed by the nozzle rows 42A and 42B after the positions of dots to be created by the movement of the nozzle row 42B in the first and second scanning directions have been subjected to the above correction.

The foregoing discharge position adjusting method and droplet ejecting apparatus in this embodiment described above produces the following effects. The discharge position adjusting method in this embodiment is a method of adjusting the positions of dots to be created by a droplet ejecting apparatus 1 by using a first image and a second image. The droplet ejecting apparatus 1 includes a first nozzle row (nozzle row 42A) and a second nozzle row (nozzle row 42B), each of which is formed of a plurality of nozzles arrayed in a first direction, or a transport direction of a paper sheet 10. The first image is created by the first nozzle row, and the second image is created by the second nozzle row. The droplet ejecting apparatus creates an image on the paper sheet 10 by performing simultaneously a scanning operation and a liquid droplet ejecting operation; in the scanning operation, both the first nozzle row and the second nozzle row reciprocate in second directions (scanning directions) intersecting the first direction, and in the liquid droplet ejecting operation, the nozzles eject ink droplets onto the paper sheet 10, creating dots that make up the image. In this method, both the first image and the second image are created through a single liquid droplet ejecting operation. The first image created by the first nozzle row and the second image created by the second nozzle row are used to adjust the positions of dots to be created. In this embodiment, the first image and the second image do not have to be created in nozzle rows at different timings. It is thus possible to adjust the positions of dots to be created in a short time.

The first image created by the first nozzle row and the second image created by the second nozzle row are created successively in the first direction. Therefore, the misalignment of the first image and the second image can be visually perceived without difficulty. Consequently, it is possible to align the first image with the second image effectively.

Each of the first image and the second image is formed of a plurality of first dot rows and a plurality of second dot rows; the first dot rows are created in the first direction by the liquid droplet ejecting operation during the movement in a first scanning direction in the scanning operation, and the second dot rows are created in the first direction and within intervals between the first dot rows by the liquid droplet ejecting operation during the movement in a second scanning direction in the scanning operation. The discharge position adjusting method in this embodiment includes a process of adjusting the position of dots to be created, in accordance with intervals between the first and second dot rows. In this embodiment, first, the plurality of first dot rows are created in the first direction with intervals therebetween by the movement in the first scanning direction. In turn, the plurality of second dot rows are created in the first scanning direction and within the intervals by the movement in the second scanning direction. Consequently, it is possible to visually perceive, without difficulty, the relative position of dots created in the movements in the first and second scanning directions.

A droplet ejecting apparatus 1 in this embodiment includes a first nozzle row and a second nozzle row (nozzle rows 42A and 42B), each of which has a plurality of nozzles arrayed in a first direction and ejecting ink droplets onto a paper sheet 10. A carriage unit 30 causes the first and second nozzle rows to reciprocate in second directions intersecting the first direction. A dot-formation positioning section 115 adjusts the relative position, in the second directions, of dots created from ink droplets by the movement in a first scanning direction and dots created from ink droplets by the movement in a second scanning direction. The droplet ejecting apparatus 1 creates a first image and a second image through a single liquid droplet ejecting operation; the first image is created by the first nozzle row and indicates a state of the adjustment made by the dot-formation positioning section 115, and the second image is created by the second nozzle row and indicates a state of the adjustment made by the dot-formation positioning section 115. In this embodiment, the first image and the second image do not have to be created in nozzle rows at different timings. It is thus possible to adjust the positions of dots to be created in a short time.

A predetermined number of nozzles in the first nozzle row (nozzle row 42A) which are arrayed at an end of the first nozzle row in the first direction (+Y direction) are positioned at the same locations in the second direction as a predetermined number of nozzles in the second nozzle row (nozzle row 42B) which are arrayed at an end of the second nozzle row (nozzle row 42B) in a direction (−Y direction) opposite to the first direction. Although positioned at different locations in the first direction, the nozzles of the first and second nozzle rows which are positioned at the same locations in the second direction can compensate for each other under the control of the timings of ejecting ink droplets. Consequently, it is possible to adjust the relative position of dots to be created by the movement of the head (nozzle row) configured above in first and second scanning directions.

Other Embodiments

Although an ink jet printer is disclosed in the foregoing embodiment, it should be noted that this description also contains the disclosures of a print apparatus, a recording apparatus, a liquid ejecting apparatus, a print method, a recording method, a liquid ejecting method, a print system, a recording system, a computer system, a program, a memory medium that stores a program, a display screen, a screen display method, and a method of manufacturing a printed matter, for example.

Although an ink jet printer is exemplified in the embodiment, this embodiment should not be interpreted as limiting the invention, because the embodiment is intended to help an understanding of the invention. Obviously, embodiments of the invention can be modified and varied without departing from the spirit of the invention and any equivalents should be included in the invention. Some embodiments that will be described below are also included in the invention.

Printer

An ink jet printer has been described in the foregoing embodiment; however, the embodiment is not limited to an ink jet printer. The technique in the embodiment may be applicable to any other liquid ejecting apparatuses that employ ink jet technology. Examples of such liquid ejecting apparatuses include a color filter manufacturing apparatus, a dyeing apparatus, a micro processing apparatus, a semiconductor manufacturing apparatus, a surface processing apparatus, a 3D molding machine, a liquid vaporizer, an organic EL manufacturing apparatus (especially, a polymer EL manufacturing apparatus), a display manufacturing apparatus, a film formation apparatus, and a DNA chip manufacturing apparatus.

Ink

Since an ink jet printer is described in the foregoing embodiment, ink is ejected from nozzles; however, there is no limitation on liquid to be ejected from nozzles. Alternatively, liquid to be ejected from nozzles may be a liquid or water containing, for example, a metal material, an organic material (especially, a polymer material), a magnetic material, a conductive material, a wiring material, a film formation material, an electronic ink, a working fluid, and a generic solution.

Head System

In the foregoing embodiment, piezo elements are used as drive elements that eject ink droplets; however, there is no limitation on the head system. The head system may be any print (recording) system that creates dot groups on a print (recording) medium by ejecting liquid in droplet form. For example, the head system may be a recording system in which nozzles sequentially eject liquid in droplet form by means of an intense electric field generated between the nozzles and an accelerating electrode placed opposite each other and a deflecting electrode gives a print information signal while the liquid droplets are flying. Other examples of the head system include: an electrostatic absorbing system in which non-deflected liquid droplets are ejected in accordance with a print information signal; a system in which a small pump exerts pressure on liquid and nozzles are mechanically vibrated by a quartz resonator, for example, whereby liquid droplets are forcedly ejected; and a recording (thermal jet) system that micro electrodes heats liquid to generate bubbles in accordance with a print information signal whereby liquid droplets are ejected.

The Number of Heads

In the foregoing embodiment, the head set has two heads (nozzle rows); however, there is no limitation on the number of heads. The head set may have an arbitrary number of heads.

Array of Nozzles

Herein, a direction in which nozzles are arrayed is not necessarily limited to a direction in which ejection holes are physically arrayed. For example, when ejection holes disposed adjacent to each other (sequentially) are arrayed at spacing shorter than their opening diameter, there are cases where the ejection holes are arrayed diagonally with respect to the X axis. If nozzles are arrayed diagonally with respect to the X axis, ink droplets may be ejected from the nozzles at different timings with respect to the speed at which the carriage unit 30 performs the scanning along the X axis. As a result, the nozzles seem to be arrayed along the Y axis. For example, if ejection holes are shifted from one another by lengths −d, when a paper sheet is scanned in the +X direction, the ejection timings of the nozzles may be delayed by td (=d/scanning speed). The shift is thereby corrected. In short, a direction in which the nozzles are virtually arrayed, as described above, may be regarded as being equivalent to a direction in which the nozzles are arrayed in an embodiment of the invention.

The entire disclosure of Japanese Patent Application No. 2015-062175 filed Mar. 25, 2015 is expressly incorporated by reference herein.

What is claimed is:

1. A discharge position adjusting method for causing a processor to execute computer-readable instructions stored in a memory, the discharge position adjustment method comprising executing on the processor the steps of:

moving a first nozzle row and a second nozzle row in first and second scanning directions opposite to each other, each of the first and second nozzle rows having a plurality of nozzles that eject liquid droplets, the first and second nozzle rows being disposed at different locations in a predetermined direction, the first and second scanning directions intersecting the predetermined direction;

a first forming step of forming first and second test images by ejecting liquid droplets from the first and second nozzle rows, respectively, when the first and second nozzle rows reciprocally move in the first and second scanning directions at one time, the first and second test images being provided directly adjacent to each other in the predetermined direction;

obtaining first, second, and third correction values based on the first and second test images, the first correction value corresponding to a first dot shift within the first test image, the second correction value corresponding to a second dot shift within the second test image, the third correction value corresponding to a third dot shift between the first and second test images; and a second forming step of forming first and second adjusted images by ejecting the liquid droplets from the first and second nozzle rows, respectively, based on the first, second, and third correction values when the first and second nozzle rows reciprocally move in the first and second scanning directions at one time, the first and second test images being provided directly adjacent to each other in the predetermined direction, wherein when the processor determines that one of the first, second, and third correction values is more than a threshold value, the processor is configured to shift designed dot positions of at least one of the first and second test images in one of the first and second scanning directions so as to form the first and second adjusted images.

2. The discharge position adjusting method according to claim 1, wherein the processor is configured to repeat the first forming step, the obtaining step and second forming step.

3. The discharge position adjusting method according to claim 1, wherein each of the first and second test images and each of the first and second adjusted images respectively includes a plurality of first dot rows and a plurality of second dot rows, the first dot rows are created in the predetermined direction by movement of the first nozzle row in the first scanning direction, the first dot rows have a plurality of gaps between the first dot rows, the second dot rows are created in the predetermined direction in the plurality of gaps by movement of the second nozzle row in the second scanning direction, wherein the first and second dot shifts correspond to a shift between the first dot rows and the second dot rows in the first and second scanning directions in the first and second test images, and the third dot shift corresponds to a shift between one of the first and second dot rows of the first test image and one of the first and second dot rows of the second test image, and the one of the first and second dot rows of the first test image and the one of the first and second dot rows of the second test image are provided directly adjacent to each other along the predetermined direction.

4. A droplet ejecting apparatus comprising:

a memory configured to store computer-readable instructions;

a first nozzle row and a second nozzle row disposed at different locations in a predetermined direction, each of the first and second nozzle rows having a plurality of nozzles that eject liquid droplets;

a scanning movement mechanism that moves the first and second nozzle rows in first and second scanning directions intersecting the predetermined direction; and a processor configured to execute the computer-readable instructions so as to:

form first and second test images by ejecting liquid droplets from the first and second nozzle rows, respectively, when the first and second nozzle rows reciprocally move in the first and second scanning directions at one time, the first and second test images being provided directly adjacent to each other in the predetermined direction;

obtain first, second, and third correction values based on the first and second test images, the first correction value corresponding to a first dot shift within the first test image, the second correction value corresponding to a second dot shift within the second test image, the third correction value corresponding to a third dot shift between the first and second test images; and form first and second adjusted images by ejecting the liquid droplets from the first and second nozzle rows, respectively, based on the first, second, and third correction values when the first and second nozzle rows reciprocally move in the first and second scanning directions at one time, the first and second test images being provided directly adjacent to each other in the predetermined direction, wherein when the processor determines that one of the first, second, and third correction values is more than a threshold value, the processor is configured to shift designed dot positions of at least one of the first and second test images in one of the first and second scanning directions so as to form the first and second adjusted images.

5. The droplet ejecting apparatus according to claim 4, wherein the first and second nozzle rows are formed in different heads, respectively.

6. The droplet ejecting apparatus according to claim 4, wherein the first and second nozzle rows partially overlap with each other in the predetermined direction.

7. The droplet ejecting apparatus according to claim 4, wherein each of the first and second test images and each of the first and second adjusted images respectively includes a plurality of first dot rows and a plurality of second dot rows, the first dot rows are created in the predetermined direction by the first nozzle row in the first scanning direction, the first dot rows have a plurality of gaps between the first dot rows, the second dot rows are created in the predetermined direction in the plurality of gaps by the second nozzle row in the second scanning direction, wherein the first and second dot shifts correspond to a shift between the first dot rows and the second dot rows in the first and second scanning directions in the first and second test images, and the third dot shift corresponds to a shift between one of the first and second dot rows of the first test image and one of the first and second dot rows of the second test image, and the one of the first and second dot rows of the first test image and the one of the first and second dot rows of the second test image are provided directly adjacent to each other along the predetermined direction.

* * * * *